US012650000B2

(12) United States Patent
Banninga et al.

(10) Patent No.: US 12,650,000 B2
(45) Date of Patent: Jun. 9, 2026

(54) PROJECT PATH OF TRAVEL OF BLADE ON A MOTOR GRADER

(71) Applicant: Deere & Company, Moline, IL (US)

(72) Inventors: Joel D. Banninga, Dubuque, IA (US); Lance R. Sherlock, Asbury, IA (US); Anthony K. Kraft, Epworth, IA (US)

(73) Assignee: Deere & Company, Moline, IL (US)

( * ) Notice: Subject to any disclaimer, the term of this patent is extended or adjusted under 35 U.S.C. 154(b) by 371 days.

(21) Appl. No.: 18/496,110

(22) Filed: Oct. 27, 2023

(65) Prior Publication Data

US 2025/0137227 A1 May 1, 2025

(51) Int. Cl.

| | |
|---|---|
| ***E02F 3/84*** | (2006.01) |
| ***E02F 3/76*** | (2006.01) |
| ***E02F 9/26*** | (2006.01) |

(52) U.S. Cl.

CPC ..... *E02F 3/844* (2013.01); *E02F 9/264* (2013.01); *E02F 3/7636* (2013.01)

(58) Field of Classification Search

None

See application file for complete search history.

(56) References Cited

U.S. PATENT DOCUMENTS

| | | | | |
|---|---|---|---|---|
| 5,107,932 | A | 4/1992 | Zachman et al. | |
| 8,985,233 | B2 * | 3/2015 | Padilla | E02F 3/7645 172/795 |
| 12,152,372 | B2 * | 11/2024 | Schau | G08G 1/16 |
| 2006/0042810 | A1 | 3/2006 | Pecchio | |
| 2013/0255977 | A1 * | 10/2013 | Braunstein | E02F 3/764 701/41 |
| 2013/0304331 | A1 * | 11/2013 | Braunstein | E02F 3/847 701/50 |
| 2014/0326471 | A1 | 11/2014 | Zhu et al. | |
| 2023/0105281 | A1 | 4/2023 | Benevelli et al. | |

FOREIGN PATENT DOCUMENTS

| | | | |
|---|---|---|---|
| DE | 112013000777 | T5 | 10/2014 |
| DE | 112013001746 | T5 | 2/2015 |
| DE | 102018207706 | A1 | 3/2019 |
| DE | 102021208668 | A1 | 3/2022 |
| DE | 102022210694 | A1 | 6/2023 |

OTHER PUBLICATIONS

German Search Report issued in application No. 102024127585.5 dated Apr. 30, 2025, 10 pages.

* cited by examiner

*Primary Examiner* — Todd Melton

(74) *Attorney, Agent, or Firm* — Taft Stettinius & Hollister LLP; Stephen F. Rost

(57) ABSTRACT

A motor grader having a front frame coupled with a rear frame, supported on front and rear wheels. A controller determines a position of actuators operably coupled with a blade attached to the grader, an articulation angle of the rear frame relative to the front frame, and a front wheel steering angle of the front wheels. The controller determines movement of the front and rear frames based on the articulation angle and the front wheel steering angle as the wheels travel over a ground surface. The controller determines a blade position and blade movement of with respect to the front and rear frames based on the position of actuators, rigid body acceleration of the motor grader, and physical characteristics of the machine assembly. The controller determines a blade trajectory path of the blade based on the movement of the front and rear frames, blade position, and blade movement.

20 Claims, 5 Drawing Sheets

PROJECT PATH OF TRAVEL OF BLADE ON A MOTOR GRADER

FIELD OF THE DISCLOSURE

The present disclosure relates to a work vehicle, such as a motor grader, for grading a surface, and in particular to a vehicle control system for determining a blade travel path based on the motor grader and position of the blade relative to the motor grader.

BACKGROUND

Work vehicles, such as a motor grader, can be used in construction and maintenance for creating a flat surface at various angles, slopes, and elevations. A motor grader can include two or more axles, with an engine and cab disposed above the axles at the rear end of the vehicle and another axle disposed at the front end of the vehicle. An implement, such as a blade, is attached to the vehicle between the front axle and rear axle.

Motor graders include a drawbar assembly attached toward the front of the grader, which is pulled by the grader as it moves forward. The drawbar assembly rotatably supports a circle drive member at a free end of the drawbar assembly and the circle drive member supports a work implement such as the blade. The angle of the work implement beneath the drawbar assembly can be adjusted by the rotation of the circle drive member relative to the drawbar assembly.

In addition to the blade being rotated about a rotational fixed axis, the blade is also adjustable to a selected angle with respect to the circle drive member. This angle is known as blade slope. The elevation of the blade is adjustable and the lateral position of the blade is also adjustable.

The motor grader includes one or more sensors which measure the orientation of the vehicle with respect to gravity, the location of the wheels, and the location of the blade with respect to the vehicle. A rotation sensor located at the circle drive member provides a rotational angle of the blade with respect to a longitudinal axis defined by a length of the vehicle. A blade slope sensor provides a slope angle of the blade with respect to a lateral axis which is generally aligned with a vehicle lateral axis, such as defined by the vehicle axles. A mainfall sensor provides an angle of travel of the vehicle with respect to gravity.

The motor grader is operated in forward and rearward directions when used. The motor grader can include a front frame movable with respect to a rear frame such that the front frame and rear frame articulate with respect to one another. Articulation of the vehicle during a grading operation is also known as "crabbing". The front and rear wheels each have a travel path on a ground surface when the motor grader travels over the ground surface. The blade can be operated independently of the front and rear wheels, and the blade can extend beyond or outside of the front wheel travel path and the rear wheel travel path. The path of travel of the motor grader can be calculated using the steering angle of the tires and the articulation angle of the mainframe. However, due to features such as the circle side shift, blade side shift or circle rotate, the path of travel of the blade can be distinct from the path of travel of the motor grader or machine.

When the motor grader is traveling in the forward or rearward directions, there is a zone or area of detection for potential objects that may be in the path of travel. When the motor grader is traveling with the front wheels turned and/or the rear axle articulated that increases or widens the zone or area of detection for potential objects. Further since the blade is operable in many different configurations this can also increase the effective width of travel of the motor grader. A wider path of travel of the motor grader increases the zone of detection area which is difficult for the operator to detect any objects in the path of travel.

Therefore, a need exists for precise machine control by referencing a grade profile that the blade will be passing over, as well being able to be used in obstacle detection to control the blade position based on detected obstacles.

BRIEF DESCRIPTION OF THE DRAWINGS

The above-mentioned aspects of the present disclosure and the manner of obtaining them will become more apparent and the disclosure itself will be better understood by reference to the following description of the embodiments of the disclosure, taken in conjunction with the accompanying drawings, wherein.

Corresponding reference numerals are used to indicate corresponding parts throughout the several views.

SUMMARY

Figure 1:
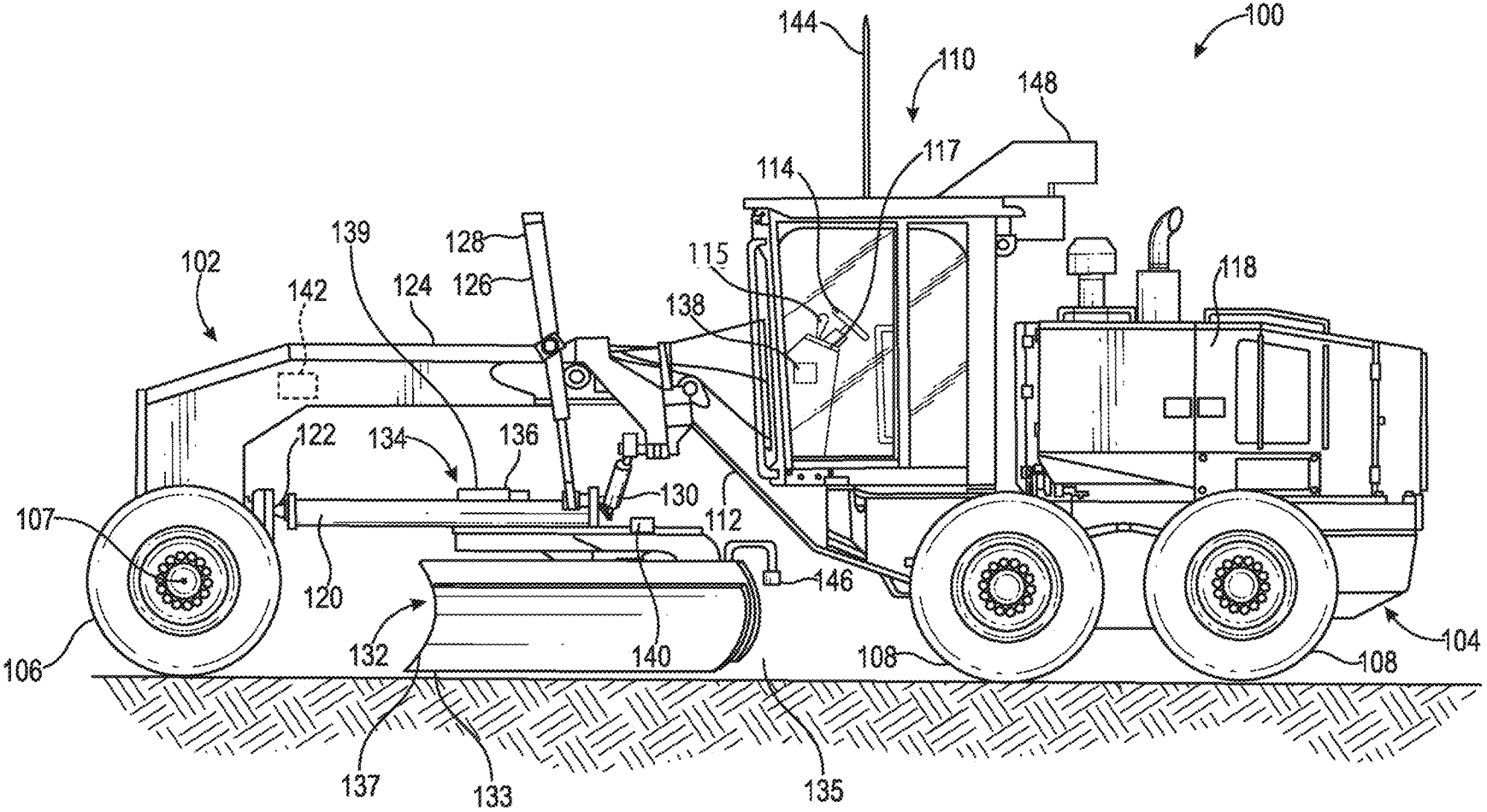
FIG. 1 is a side view of an exemplary embodiment of a motor grader.

According to one embodiment of the present disclosure, a motor grader comprising: a front frame supported on a pair of front wheels that are mounted on a front axle; a rear frame supported on a pair of rear wheels that are mounted on a rear axle, the rear frame coupled with the front frame; a blade movably attached to the front frame, the blade having a blade length that spans between a left outer edge and a right outer edge; a vehicle grade control system including: one or more sensors arranged to sense a position of one or more actuators operably coupled with the blade, wherein the one or more sensors are also arranged to sense an articulation angle of the rear frame relative to the front frame, wherein the one or more sensors are also arranged to sense a front wheel steering angle of the pair of front wheels; a controller including a computing device having a processor and a memory, the controller operatively coupled to the one or more sensors to receive the sensed position of the one or more actuators, the sensed position of the articulation angle, and the sensed position of the front wheel steering angle, wherein the controller: determines movement of the front frame and the rear frame based on the articulation angle and the front wheel steering angle as the pairs of front and rear wheels travel over a ground surface; determines a blade position and a blade movement of the blade with respect to the front and the rear frames based on the sensed position of the one or more actuators; and determines a blade trajectory path of the blade based on the determined movement of the front frame and the rear frame and the determined blade position and the blade movement of the blade.

In one example, wherein the blade trajectory path of the blade includes a left outer edge blade travel path of the left outer edge of the blade and a right outer edge blade travel path of the right outer edge of the blade.

In one example, wherein the controller displays the blade trajectory path of the blade on a graphical user interface.

In one example, wherein the controller compares the blade trajectory path of the blade to a grade profile to determine whether a position of the blade needs adjustment.

In one example, wherein the controller receives image data from an image sensor operatively coupled to the controller; and wherein the controller determines whether an obstacle in the image data is within the blade trajectory path of the blade.

In one example, wherein the controller determines the blade position and the blade movement of the blade with respect to the motor grader includes: the controller determines one or more machine assembly characteristics of the motor grader; the controller determines a cylinder velocity of each of the one or more actuators; and the controller determines a rigid-body acceleration of the motor grader.

In one example, wherein the controller determines the blade position and the blade movement of the blade with respect to the motor grader includes: the controller receiving from a user an operator command to direct the blade movement of the blade.

In one example, wherein the controller determines the blade position and the blade movement of the blade with respect to the motor grader includes: the controller determines a machine footprint of the front frame and the rear frame.

In one example, further comprising: wherein the controller determines a blade travel path relative to a grade profile; and the controller automatically moves the blade in response to the grade profile to adjust the blade travel path.

In one example, wherein the controller determines one or more physical characteristics of a machine assembly of the motor grader; wherein the controller determines the movement of the front frame and the rear frame includes the one or more physical characteristics of the machine assembly of the motor grader; and wherein the controller determines the blade position and the blade movement of the blade with respect to the front and the rear frames includes the one or more physical characteristics of the machine assembly of the motor grader.

In one example, wherein the one or more physical characteristics of the machine assembly of the motor grader includes a blade length, a blade height, and a blade thickness of the blade.

In one example, wherein the one or more physical characteristics of the machine assembly of the motor grader includes a cylinder mounting location for each of the actuators on the motor grader and/or the actuators assembled with the blade.

In one example, wherein the one or more actuators include any of a right and a left extensible and retractable actuator, a circle side shift actuator, a side swing actuator, and a blade lift valves assembly.

According to one embodiment of the present disclosure, a method of determining a blade trajectory path of a blade movably attached to a motor grader having a front frame supported on a pair of front wheels that are mounted on a front axle and a rear frame supported on a pair of rear wheels that are mounted on a rear axle, the rear frame coupled with the front frame, the method comprising: determining, via a controller including a computing device having a processor and a memory, a position of one or more actuators operably coupled with the blade; determining, via the controller, an articulation angle of the rear frame relative to the front frame; determining, via the controller, a front wheel steering angle of the pair of front wheels; determining, via the controller, movement of the front frame and the rear frame based on the articulation angle and the front wheel steering angle as the pairs of front and rear wheels travel over a ground surface; determining, via the controller, a blade position and a blade movement of the blade with respect to the front and the rear frames based on the sensed position of the one or more actuators; and determining, via the controller, a blade trajectory path of the blade based on the determined movement of the front frame and the rear frame and the determined blade position and the blade movement of the blade.

In one example, determining, via the controller, a blade travel path of the blade relative to a grade profile of a ground surface.

In one example, moving, via the controller, the blade automatically in response to the grade profile to adjust the blade travel path.

In one example, wherein the determining, via the controller, the blade position and the blade movement of the blade with respect to the motor grader includes: determining, via the controller, one or more machine assembly characteristics of the motor grader; determining, via the controller, a cylinder velocity of each of the one or more actuators; and determining, via the controller, a rigid-body acceleration of the motor grader.

In one example, wherein the one or more actuators include any of a right and a left extensible and retractable actuator, a circle side shift actuator, a side swing actuator, and a blade lift valves assembly.

In one example, wherein the blade trajectory path of the blade includes a left outer edge blade travel path of the left outer edge of the blade and a right outer edge blade travel path of the right outer edge of the blade.

In one example, further comprising: receiving from a user an operator command to direct the blade movement of the blade; and moving via the controller the blade in response to the directed blade movement.

DETAILED DESCRIPTION

The embodiments of the present disclosure described below are not intended to be exhaustive or to limit the disclosure to the precise forms in the following detailed description. Rather, the embodiments are chosen and described so that others skilled in the art may appreciate and understand the principles and practices of the present disclosure.

Referring to FIG. 1, an exemplary embodiment of a vehicle, such as a motor grader 100, is shown. An example of a motor grader is the 772G Motor Grader manufactured and sold by Deere & Company. While the present disclosure discusses a motor grader, other types of work machines are contemplated including graders, road graders, to name a few that may have an implement such as a blade that is used for grade control.

As shown in FIG. 1, the motor grader 100 includes front frame 102 and rear frame 104, with the front frame 102 being supported on a pair of front wheels 106 that are mounted on a front axle 107, and with the rear frame 104 being supported on right and left tandem sets of rear wheels 108. A straight line extending between the wheel centers generally defines a wheel axis transverse to a longitudinal plane of the vehicle 100 and generally parallel to wheel treads in contact with the surface being graded. In one or more embodiments, the front frame 102 and rear frame 104 are fixedly coupled together. In still other embodiments, the front frame 102 and rear frame 104 are moveable with respect to one another such that the front frame 102 and rear frame 104 articulate with respect to one another. Articulation of the vehicle during a grading operation is also known as "crabbing".

An operator cab 110 is mounted on an upwardly and inclined rear region 112 of the front frame 102 and contains various controls for the motor grader 100 disposed so as to be within the reach of a seated or standing operator. In one aspect, these controls may include a steering wheel 114 and a lever assembly 115. A user interface 117 is supported by a console located in the cab and includes one or more different types of operator controls including manual and electronic buttons of switches. In different embodiments, the user interface 117 includes a visual display providing operator selectable menus for controlling various features of the vehicle 100. In one or more embodiments, a video display is provided to show images provided by an image sensor 148 or cameras located on the vehicle.

An engine 118 is mounted on the rear frame 104 and supplies power for all driven components of the motor grader 100. The engine 118, for example, is configured to drive a transmission (not shown), which is coupled to drive the rear wheels 108 at various selected speeds and either in forward or reverse modes. A hydrostatic front wheel assist transmission (not shown), in different embodiments, is selectively engaged to power the front wheels 106, in a manner known in the art.

Mounted to a front location of the front frame 102 is a drawbar or draft frame 120, having a forward end universally connected to the front frame 102 by a ball and socket arrangement 122 and having opposite right and left rear regions suspended from an elevated central section 124 of the front frame 102. Right and left lift linkage arrangements including right and left extensible and retractable actuators 126 and 128, respectively, support the left and right regions of the drawbar 120. The actuators 126 and 128 can be hydraulic. The right and left lift linkage arrangements 126 and 128 either raise or lower the drawbar 120. A side shift linkage arrangement is coupled between the elevated frame section 124 and a rear location of the drawbar 120 and includes an extensible and retractable side swing actuator 130. The extensible and retractable side swing actuator 130 can be hydraulic. A blade or mold board 132 is coupled to the front frame 102 and powered by a circle drive assembly 134. The blade 132 includes an edge 133 configured to cut, separate, or move material. The blade 132 includes a left outer edge 135 and a right outer edge 137 with a length that spans between the left and right outer edges 135 and 137, respectively. While a blade 132 is described herein, other types of implements are contemplated.

The drawbar 120 is raised or lowered by the right and left lift linkage arrangements 126 and 128 which in turn raises or lowers the blade 132 with respect to the surface. The actuator 130 raises or lowers one end of the blade 132 to adjust the slope of the blade.

The circle drive assembly 134 includes a circle side shift actuator 139 and a rotation sensor 136, which in different embodiments, includes one or more switches that detect movement, speed, or position of the blade 132 with respect to the vehicle front frame 102. The rotation sensor 136 is electrically coupled to a controller 138, which in one embodiment is located in the cab 110. In other embodiments, the controller 138 is located in the front frame 102, the rear frame 104, or within an engine compartment housing the engine 118. In still other embodiments, the controller 138 is a distributed controller having separate individual controllers distributed at different locations on the vehicle. In addition, while the controller is generally hardwired by electrical wiring or cabling to sensors and other related components, in other embodiments the controller includes a wireless transmitter and/or receiver to communicate with a controlled or sensing component or device which either provides information to the controller or transmits controller information to controlled devices.

A blade slope/position sensor 140 is configured to detect the slope and/or position of the blade 132 and to provide slope and/or position information to the controller 138. The blade slope/position sensor 140 is also configured to detect a left and a right blade travel path for the left and right outer edges 135 and 137 as described below. In different embodiments, the blade slope/position sensor 140 is coupled to a support frame for the blade 132 of the hydraulic actuator 130 to provide the slope information. A mainfall sensor 142 is configured to detect the grading angle of the vehicle 100 with respect to gravity and to provide grading angle information to the controller 138. The mainfall sensor 142 is configured to measure one or more of angles of slope, tilt, elevation, or depression with respect to gravity. In one embodiment, the mainfall sensor 142 includes an inertial measurement unit (IMU) configured to determine a roll position and a pitch position with respect to gravity. In additional embodiments, the grade control system includes devices, apparatus, or systems configured to determine the mainfall of the vehicle 100. In one embodiment, an inertial measurement unit (IMU) is used to determine a specific force, angular rate, and orientation of the vehicle 100. In other embodiments, the mainfall sensor 142 includes other inclination measuring devices for measuring an angle of the vehicle, such as an inclinometer. The mainfall sensor 142 provides a signal including roll and pitch information of the straightline axis between wheel centers and consequently roll and pitch information of the vehicle 100. The roll and pitch information is used by the ECU 150 to adjust the position of the blade 132.

Figure 3:
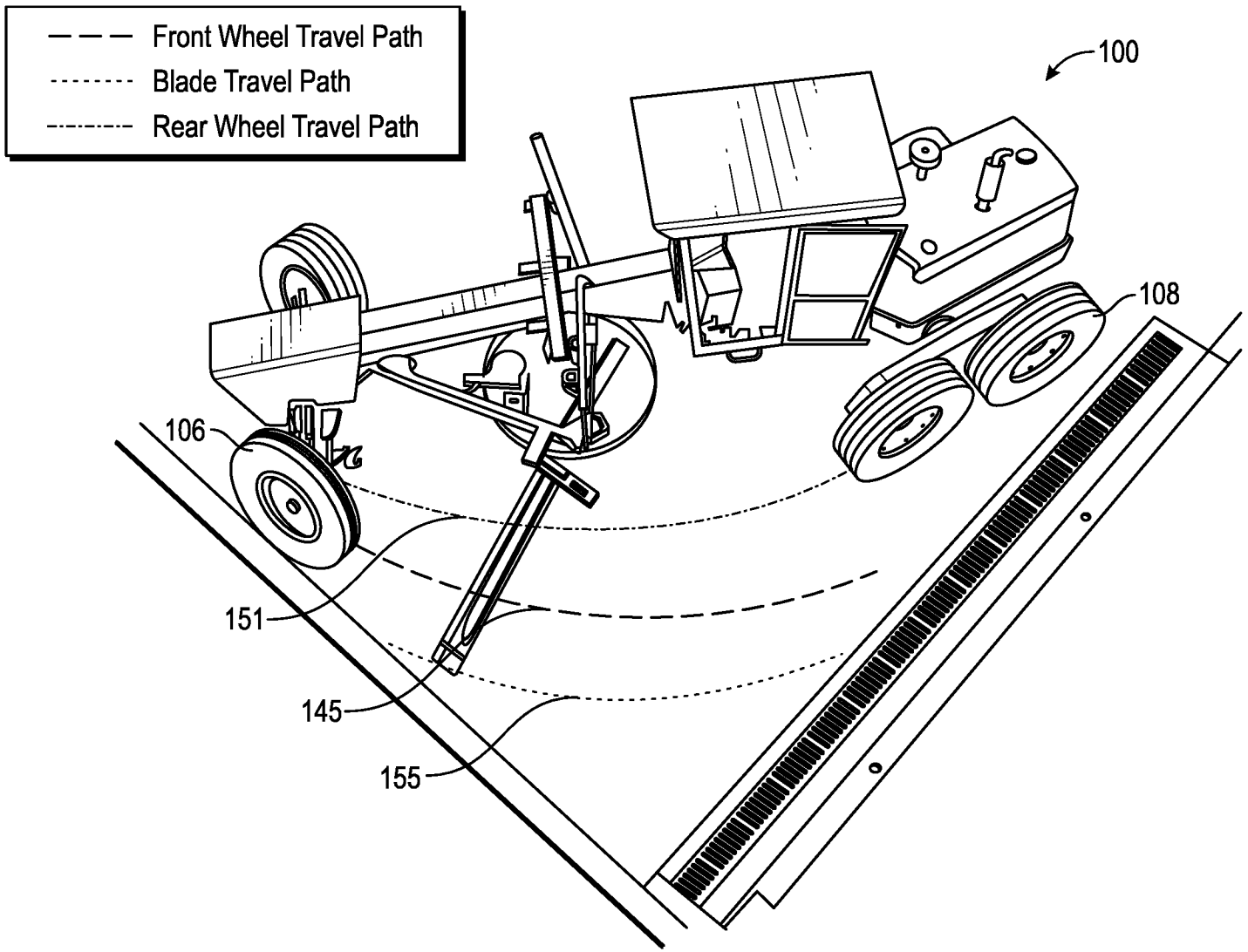
FIG. 3 is a schematic of the motor grader illustrated in FIG. 1 moving in a forward, turning direction with a front wheel travel path, a rear wheel travel path, and a blade travel path illustrated.
Figure 4:
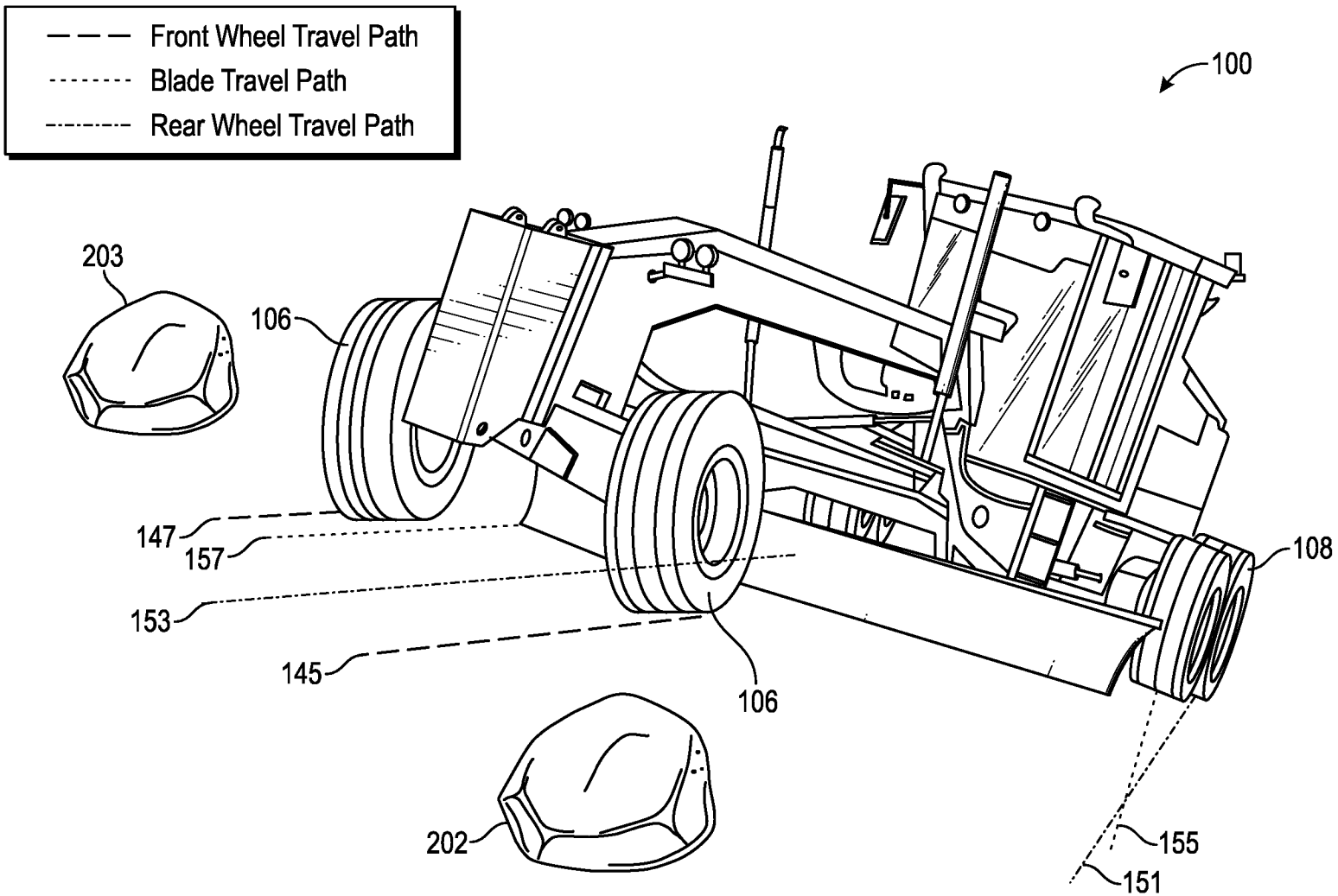
FIG. 4 is a schematic of the motor grader illustrated in FIG. 1 moving in an articulated arrangement on a side slope in a forward direction with a front wheel travel path, a rear wheel travel path, and a blade travel path illustrated.

The vehicle 100 includes one or more front wheel steering angle sensors 143 that are associated with the pair of front wheels 106. As illustrated in FIGS. 3 and 4, the one or more front wheel steering angle sensors 143 determine a front left wheel travel path 145 for the left front wheel 106 and a front right wheel travel path 147 for the right front wheel 106. The vehicle 100 includes one or more rear wheel steering angle sensors 149 that are associated with the pair of rear wheels 108. The one or more rear wheel steering angle sensors 149 determine a rear left wheel travel path 151 for the left rear wheel 108 and a rear right wheel travel path 153 for the right rear wheel 108. The vehicle 100 includes one or more articulation steering angle sensors 159 associated with the front frame 102 and the rear frame 104 to determine the position of the front frame 102 with respect to the rear frame 104 during articulation.

A left blade travel path 155 for the left outer edge 135 of the blade 132 and a right blade travel path 157 for the right outer edge 137 of the blade 132 are illustrated in FIG. 4. FIG. 3 illustrates the left blade travel path 155 for the left outer edge 135 of the blade 132 when the vehicle 100 is traveling in a turning configuration. The left blade travel path 155 for the left outer edge 135 of the blade 132 and the right blade travel path 157 for the right outer edge 137 of the blade 132 are described in more detail below.

FIGS. 3 and 4 illustrate the vehicle 100 moving along a ground surface in a forward direction. In FIG. 4 the surface protrusions or objects 202 and 203 are illustrated. It is contemplated that the vehicle 100 can also move in a rearward direction and the same disclosure of the present application is applicable for movement of the vehicle 100 in a rearward direction. As the vehicle moves along the ground surface, the ground image sensor 148 provides images of the surface located in front of or behind the vehicle 100, i.e., in a forward or a rearward direction. During this movement, the surface (including the irregularities), is imaged by the ground sensor and the images are transmitted to the ECU 150. A field of view of the ground image sensor 148 includes a width, in at least one embodiment, sufficient to provide a view of one or more upcoming surface irregularities 202 and 203. Surface irregularity 202 is any protrusion, object, obstacle, bump, or even a person that is generally elevated above the surface and can be of a size that is within a contact zone of the vehicle. Surface irregularity 203 is any protrusion, object, obstacle, bump, or even a person that is generally elevated above the surface and can be of a size that is not within a contact zone of the vehicle. For the purposes of this disclosure, the irregularities are deviations from the ground surface.

As the vehicle 100 moves along the path 198, the front wheels 106 correspond to a front steering position, the rear wheels 108 correspond to a rear steering position, and the implement or blade 132 corresponds to an implement position relative to the surface. The ECU 150 receives the location of the surface irregularities 202 and 203 and determines the location of the surface irregularities 202 and 203 relative to the front steering position, the rear steering position, and the implement position of the vehicle 100. The ECU 150 determines the location of the surface irregularity 202 is within any of the front steering position, the rear steering position, and the implement position, and the ECU 150 determines the location of the surface irregularity 203 is not within the path of travel 204 of the vehicle 100. The ECU 150 also determines a vehicle zone of operation 304 using the front steering position, the rear steering position, and the implement position.

The ECU 150 also determines the front steering position by identifying a first and a second front wheel location input that respectively corresponds to the first and the second front wheel 106. The ECU 150 also determines the rear steering position by identifying a first and a second rear wheel location input that respectively corresponds to the first and the second rear 6 wheel 108. The ECU 150 also determines the implement position by identifying a position of the implement or blade 132 with respect to the front frame 102 or the rear frame 104 of the vehicle 100.

An antenna 144 is located at a top portion of the cab 110 and is configured to receive signals from different types of machine control systems including sonic systems, laser systems, and global positioning systems (GPS). While the antenna 144 is illustrated, other locations of the antenna 144 are included as is known by those skilled in the art. For instance, when the vehicle 100 is using a sonic system, a sonic tracker 146 is used to detect reflected sound waves transmitted by the sonic system with the sonic tracker 146. In a vehicle 100 using a laser system, a mast (not shown) located on the blade supports a laser tracker located at a distance above the blade 132. In one embodiment, the mast includes a length to support a laser tracker at a height similar to the height of a roof of the cab. A GPS system includes a GPS tracker located on a mast similar to that provided for the laser tracker system. Consequently, the present disclosure applies vehicle motor grader systems using both relatively "simple" 2D cross slope systems and to "high end" 3D grade control systems.

A ground image sensor 148 is fixedly mounted to the cab 110 at a location generally unobstructed by any part of the vehicle 100. The ground image sensor 148 includes one or more of a transmitter, receiver, or a transceiver directed to the ground rearward of and being approached by the vehicle 100 when the vehicle 100 is traveling in a rearward or forward direction as indicated by path 198. In different embodiments, the ground image sensor 148 includes one or more of a two dimensional camera, a radar device, and a laser scanning device, and a light detection and ranging (LIDAR) scanner. The ground image sensor 148 is configured to provide an image of the ground and any surface irregularities 202 and 203 being approached by the vehicle 100 which is transmitted to an electronic control unit (ECU) 150 of FIG. 2. In different embodiments, the ground image sensor 148 is one of a grayscale sensor, a color sensor, or a combination thereof.

Figure 2:
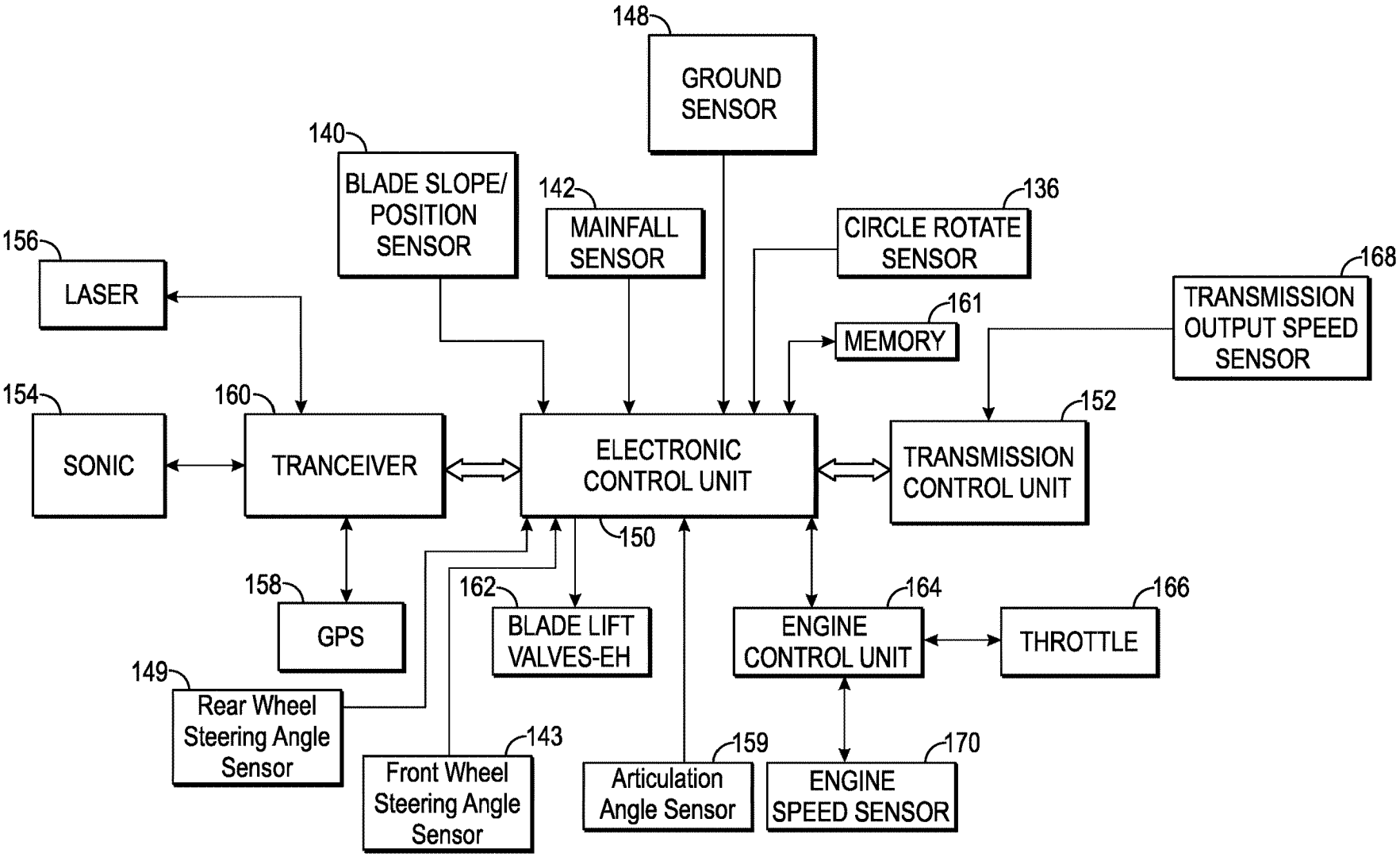
FIG. 2 is a simplified schematic diagram of a vehicle and a vehicle grade control system of the present disclosure.

FIG. 2 is a simplified schematic diagram of the vehicle 100 and a vehicle grade control system embodying the invention. In this embodiment, the controller 138 is configured as the ECU 150 operatively connected to a transmission control unit 152. The ECU 150 is located in the cab 110 of vehicle 100 and the transmission control unit 152 is located at the transmission of the vehicle 100. The ECU 150 receives slope, angle, and/or elevation signals generated by one or more types of machine control systems including a sonic system 154, a laser system 156, and a GPS system 158. Other machine control systems are contemplated. These signals are collectively identified as contour signals. Each of the machine control systems 154, 156, and communicates with the ECU 150 through a transceiver 160 which is operatively connected to the appropriate type of antenna as is understood by those skilled in the art.

The ECU 150, in different embodiments, includes a controller, computer, computer system, or other programmable devices. In other embodiments, the ECU 150 can include one or more processors (e.g. microprocessors), and an associated memory 161, which can be internal to the processor of external to the processor. The memory 161 can include random access memory (RAM) devices comprising the memory storage of the ECU 150, as well as any other types of memory, e.g., cache memories, non-volatile or backup memories, programmable memories, or flash memories, and read-only memories. In addition, the memory can include a memory storage physically located elsewhere from the processing devices and can include any cache memory in a processing device, as well as any storage capacity used as a virtual memory, e.g., as stored on a mass storage device or another computer coupled to ECU 150. The mass storage device can include a cache or other dataspace which can include databases. Memory storage, in other embodiments, is located in the "cloud", where the memory is located at a distant location which provides the stored information wirelessly to the ECU 150.

The ECU 150 executes or otherwise relies upon computer software applications, components, programs, objects, modules, or data structures, etc. Software routines resident in the included memory of the ECU 150 or other memory are executed in response to the signals received. The computer software applications, in other embodiments, are located in the cloud. The executed software includes one or more specific applications, components, programs, objects, modules or sequences of instructions typically referred to as "program code". The program code includes one or more instructions located in memory and other storage devices which execute the instructions which are resident in memory, which are responsive to other instructions generated by the system, or which are provided a user interface operated by the user. The ECU 150 is configured to execute the stored program instructions.

The ECU 150 is also operatively connected to a blade lift valves assembly 162 (see FIG. 2) which is in turn operatively connected to the right and left lift linkage arrangements 126 and 128 and the side swing actuator 130. The blade lift valves assembly 162, in one embodiment, is an electrohydraulic (EH) assembly which is configured to raise or lower the blade 132 with respect to the surface or ground and to one end of the blade to adjust the slope of the blade. In other embodiments, the blade lift valves assembly 162 includes one or more actuators to control a blade pitch of the blade 132. In different embodiments, the valve assembly 162 is a distributed assembly having different valves to control different positional features of the blade. For instance, one or more valves adjust one or both of the linkage arrangements 126 and 128 in response to commands generated by and transmitted to the valves and generated by the ECU 150. Another one or more valves, in different embodiments, adjusts the actuator 130 in response to commands transmitted to the valves and generated by the ECU 150. The ECU 150 responds to grade status information, provided by the sonic system 154, the laser system 156, and the GPS 158, and in some embodiments can adjust the location of the blade 132 through control of the blade lift valves assembly 162. The location of the blade is adjusted based on the current position of the blade with respect to the vehicle, speed of blade if being manipulated, and the direction of the blade. Alternatively, the ECU 150 also responds to operator input to adjust the location of the blade 132.

The ECU 150 is coupled to the transmission control unit 152 to control the amount of power applied to the wheels of the vehicle 100. The ECU 150 is further operatively connected to an engine control unit 164 which is, in part, configured to control the engine speed of the engine 116. A throttle 166 is operatively connected to the engine control unit 164. In one embodiment, the throttle 166 is a manually operated throttle located in the cab 110 which is adjusted by the operator of vehicle 100. In another embodiment, the throttle 166 is additionally a machine controlled throttle which is automatically controlled by the ECU 150 in response to grade information and vehicle speed information.

The ECU 150 provides engine control instructions to the engine control unit 164 and transmission control instruction to the transmission control unit 152 to adjust the speed of the vehicle in response to front wheel location, front wheel speed, front wheel slip, rear wheel location, rear wheel speed, rear wheel slip, blade or implement position, and surface irregularity detection information provided by one of the machine control systems including the sonic system 154, the laser system 156, the GPS system 158, and the ground image sensor 148. Other machine control systems can also be used to determine the engine control instructions. Vehicle direction information is determined by the ECU 150 in response to direction information provided by the steering device 114.

Vehicle speed information is provided to the ECU 150, in part, by the transmission control unit 152 which is operatively connected to a transmission output speed sensor 168. The transmission output speed sensor 168 provides a sensed speed of an output shaft of the transmission, as is known by those skilled in the art. Additional transmission speed sensors are used in other embodiments including an input transmission speed sensor which provides speed information of the transmission input shaft.

Additional vehicle speed information is provided to the ECU 150 by the engine control unit 164. The engine control unit 164 is operatively connected to an engine speed sensor 170 which provides engine speed information to the engine control unit 164.

A current vehicle speed is determined at the ECU 150 using speed information provided by one of or both of the transmission control unit 152 and the engine control unit 164. The current vehicle speed can be determined at the ECU 150 using speed information provided by any of the sonic system 154, the laser system 156, and the GPS system 158. The speed of the vehicle 100 is decreased or increased by speed control commands provided by the ECU 150.

As one of ordinary skill can appreciate, the blade 132 can be configured in multiple different ways relative to the front frame 102 and the front wheels 106 and the rear frame 104 and the rear wheels 108. For example, the blade 132 can slide laterally beyond the front wheels and/or the rear wheels 108 which increases the overall effective width of vehicle 100 and also increases the either the left blade travel path 155 for the left outer edge 135 of the blade 132 or the right blade travel path 157 for the right outer edge 137 of the blade 132. As can be appreciated, the blade 132 can move to a wide out position which is the maximum distance the blade 132 can move laterally.

Figure 5:
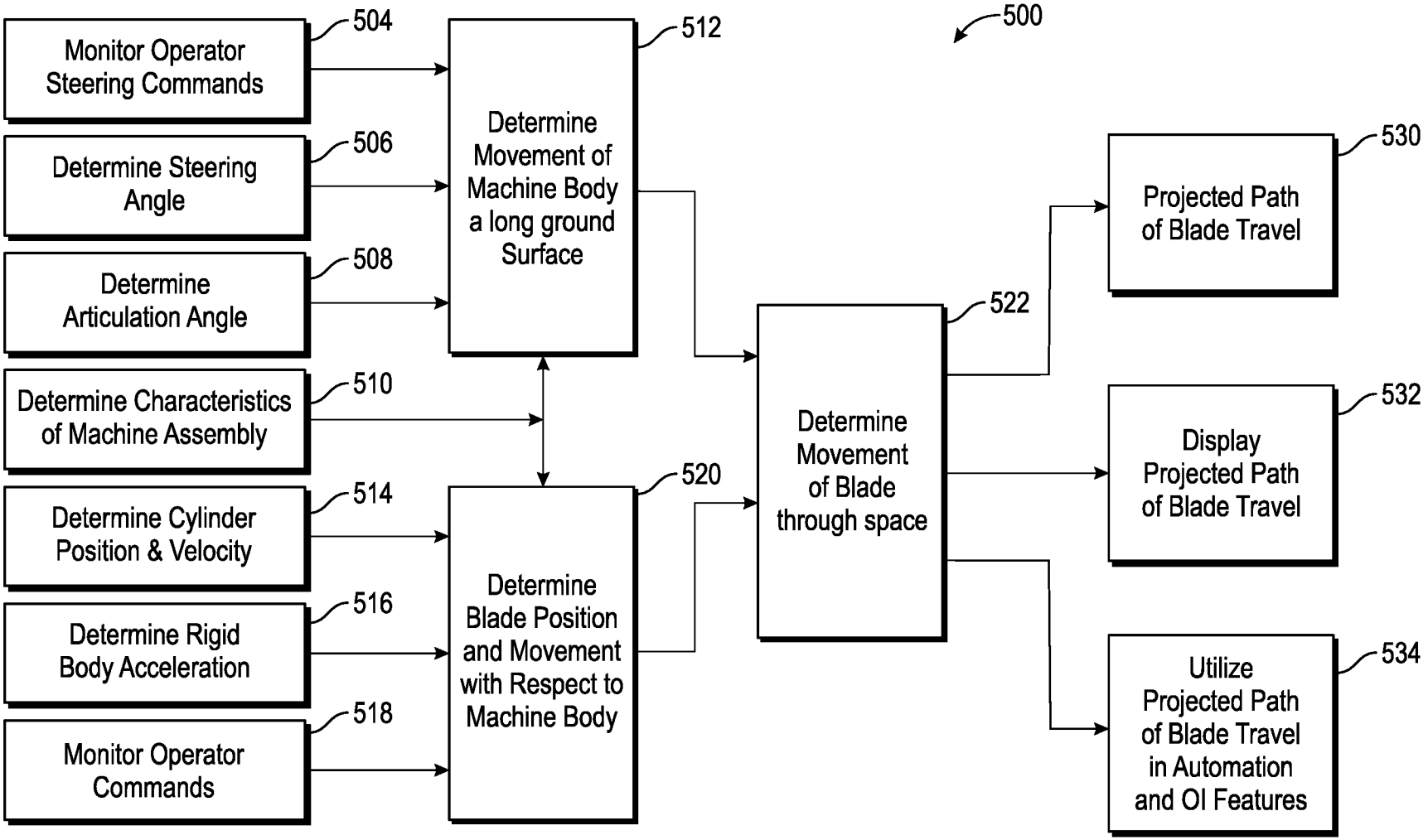
FIG. 5 is a flow diagram of a method to determine a blade trajectory path of the blade as the motor grader illustrated in FIG. 1 moving along a ground surface.

FIG. 5 illustrates a flow diagram of a process 500 to determine a blade trajectory path of the blade 132 as the vehicle 100 travels along a ground surface. The process 500 includes step 512 to determine movement of the vehicle 100 on a ground surface and step 520 to determine a blade position and blade movement of the blade 132 with respect to the vehicle 100. The process 500 then combines the steps 512 and 520 into step 522 to determine a blade travel path of the blade 132.

To determine movement of the vehicle 100 on a ground surface in step 512, the process 500 begins with based on the following steps: monitor an operator steering command 504, determine a steering angle 506, and determine an articulation angle 508. Monitor operator steering command 504 includes the ECU 150 receiving an operator input or a vehicle input to cause the vehicle 100 to move in any of or a combination of a forward or rearward direction, a turning direction, and/or an articulation configuration as described above. For instance, the operator begins a rearward movement of the vehicle 100 by providing an input to the user interface 117, such as a gear shift into reverse. The ECU 150 determines that the vehicle 100 is moving in a rearward direction. As another example, the operator begins a forward movement of the vehicle 100 by providing another input to the user interface 117, such as a gear shift into drive. The ECU 150 determines that the vehicle 100 is moving in a forward direction. As yet another example, the operator begins a turning movement of the vehicle 100 by turning the steering wheel 114 as shown in FIG. 3. The ECU 150 determines that the vehicle 100 is moving in turning direction either forward or rearward. As yet another example, the operator begins an articulated movement of the vehicle 100 as shown in FIG. 4 and described above.

Determine steering angle 506 includes the ECU 150 determining and/or measuring the front steering position of the front wheels 106 and the rear steering position of the rear wheels 108 based on feedback from the one or more front wheel steering angle sensors 143 and the one or more rear wheel steering angle sensors 149. The front steering position includes identifying the front left wheel travel path 145 for the left front wheel 106 and the front right wheel travel path 147 for the right front wheel 106 by the one or more front wheel steering angle sensors 143. The rear steering position includes identifying the rear left wheel travel path 151 for the left rear wheel 108 and the rear right wheel travel path 153 for the right rear wheel 108 by the one or more rear wheel steering angle sensors 149.

Determine articulation angle 508 includes the ECU 150 determining and/or measuring the position of the front frame 102 with respect to the rear frame 104 during articulation of the vehicle 100 by the one or more articulation steering angle sensors 159 associated with the front frame 102 and the rear frame 104.

In step 510, the process 500 includes the ECU 150 determining or measuring physical characteristics of the machine assembly of the vehicle 100. Machine assembly of the vehicle 100 includes one or more physical characteristics of the blade 132 such as the blade length, blade height, and in some embodiments blade thickness. The physical characteristics of the blade 132 can be stored in the memory 161 based on the type of blade 132 that is assembled with the vehicle 100. It can be appreciated that when the type of blade 132 changes on the vehicle 100 that these physical characteristics will change accordingly. Machine assembly of the vehicle 100 can also include one or more physical characteristics of the front frame 102 and the rear frame 104. Machine assembly of the vehicle 100 includes a cylinder mounting location of the actuators on the vehicle 100 and/or the blade 132. Step 510 includes determining or measuring a cylinder mounting position of the right and left extensible and retractable actuators 126 and 128, respectively, that support the left and right regions of the drawbar 120. Step 510 includes determining or measuring a cylinder mounting position of the circle side shift actuator 139. Step includes determining or measuring a cylinder mounting position of the side swing actuator 130. Step 510 includes determining or measuring a cylinder mounting position of the blade lift valves assembly 162 that includes one or more actuators to control the blade pitch of the blade 132. Step 510 includes determining or measuring a machine footprint of the front and rear frames 102 and 104, respectively.

In step 512, the process 500 includes determining movement of the vehicle 100 on a ground surface based on the following steps: monitor operator steering command 504, determine steering angle 506, determine articulation angle 508, and determine or measure characteristics of machine assembly 510 of the vehicle 100. In step 512, the ECU 150 determines a vehicle travel path of the vehicle 100 in the direction that the vehicle 100 is moving. For example, if the vehicle 100 is moving in a forward direction then the vehicle travel path is forward of the vehicle 100. If the vehicle is moving in a rearward direction then the vehicle travel path is rearward of the vehicle 100. The vehicle travel path is defined as the widest travel path or widest vehicle footprint of the vehicle 100 as the vehicle 100 travels along the ground surface.

To determine a blade position and blade movement of the blade 132 with respect to the vehicle 100 in step 520, the process 500 begins with the following steps: determine a cylinder position and cylinder velocity 514, determine a rigid body acceleration 516, and monitor operator commands for blade movement 518. In step 514, the ECU 150 determines or measures the cylinder position and velocity for each of the cylinders that are assembled with the blade 132 to cause the blade 132 to move. In step 514, the ECU 150 determines or measures the dynamic movement of the blade 132 wherein the movement of the blade 132 is constantly changing and progressing based on the cylinder position and velocity for each of the cylinders that are assembled directly or indirectly with the blade 132. Step 514 includes determining or measuring a cylinder position and velocity of the right and left extensible and retractable actuators 126 and 128, respectively, that support the left and right regions of the drawbar 120. Step 514 includes determining or measuring a cylinder position and velocity of the circle side shift actuator 139. Step 514 includes determining or measuring a cylinder position and velocity of the side swing actuator 130. Step 514 includes determining or measuring a cylinder position and velocity of the blade lift valves assembly 162 that includes one or more actuators to control the blade pitch of the blade 132. The ECU 150 determines or measures the dynamic movement of the blade 132 based on any of the dynamic blade inputs that correspond to the cylinder position and velocity for each of the cylinders that are assembled with the blade 132 of step 514.

In step 516, the ECU 150 determines or measures the rigid body acceleration of the vehicle 100 including the front frame 102 and the rear frame 104 as the vehicle 100 moves in either forward or rearward directions. Step 516 includes determining or measuring a rigid-body motion, relative velocity, and/or acceleration of the vehicle 100 including the front frame 102 and the rear frame 104. In some embodiments, step 516 determines or measures the rigid body acceleration of other or additional parts of the vehicle 100. In step 516, the ECU 150 determines or measures the dynamic movement of the vehicle 100 wherein the movement of the vehicle 100 is constantly changing and progressing as the vehicle 100 travels over the ground surface. Some of the dynamic machine inputs can include any of an IMU of the blade 132 coupled with the grade control system illustrated in FIG. 2 to determine a roll position and a pitch position of the blade 132 with respect to gravity, an IMU of the vehicle 100 coupled with the grade control system in FIG. 2 that determines a specific force, angular rate, and orientation of the vehicle 100, wheel speed of the front and rear wheels 106 and 108, respectively, vehicle travel speed of the vehicle 100, and wheel slip of the front and rear wheels 106 and 108, respectively. The dynamic machine inputs can also include the vehicle speed information provided by the transmission control unit 152 or the engine control unit 164. The dynamic machine inputs can also include the engine speed of the engine 116. The ECU 150 determines or measures the dynamic movement of the vehicle 100 based on any of the dynamic machine inputs to determine the rigid body acceleration of the vehicle 100 of step 516.

In step 518, the monitor operator commands for blade movement 518 includes the ECU receiving one or more operator commands directed to move the blade 132 in an upward, downward, side shift, rotate, and/or tilt directions.

In step 520, the process 500 includes determining a blade position and blade movement of the blade 132 with respect to the vehicle 100 based on the steps of determining the characteristics of machine assembly 510 of the vehicle 100, the cylinder position and cylinder velocity 514 of the blade 132, the rigid-body acceleration 516 of the vehicle 100, and the operator commands for blade movement 518. In step 520, the ECU 150 determines the blade position and blade movement of the blade 132 with respect to the vehicle 100 that accounts for a blade offset of the left and right outer edges 135 and 137, respectively, of the blade 132 with respect to the front frame 102, the rear frame 104, the front wheels 106, and the rear wheels 108 as the vehicle 100 and the blade 132 travel over the ground surface. In step 520, the ECU 150 determines the blade position and blade movement of the blade 132 with respect to the vehicle 100 to determine a blade elevation of the edge 133 of the blade 132 relative to the front frame 102, the rear frame 104, the front wheels 106, and the rear wheels 108 as the vehicle 100 and the blade 132 travel over the ground surface.

In step 522, the ECU 150 determines movement of the blade 132 based on the movement of the vehicle 100 from step 512 and the blade position and blade movement of the blade 132 with respect to the vehicle 100 from step 520. The ECU 150 determines the blade position and blade movement of the blade 132 by comparing the blade position and blade movement of the blade 132 with respect to the vehicle 100 from step 520 to the movement of the vehicle 100 from step 512 to isolate the blade movement and location of the left and right outer edges 135 and 137, respectively, of the blade 132. In some embodiments, step 520 also isolates the blade movement and location of the blade edge 133 of the blade 132. The movement of the left and right outer edges 135 and 137, respectively, of the blade 132 corresponds to the left blade travel path 155 for the left outer edge 135 of the blade 132 and the right blade travel path 157 for the right outer edge 137 of the blade 132. Step 520 accounts for movement of the left and right outer edges 135 and 137, respectively, of the blade 132.

In step 530, the ECU 150 determines a projected path of blade travel of the blade 132 based on the movement of the blade 132 from step 522 as the vehicle 100 moves along the ground surface. The projected path of blade travel of the blade 132 includes the left blade travel path 155 for the left outer edge 135 and the right blade travel path 157 for the right outer edge of the blade 132. In step 530, the ECU 150 determines a blade travel path of the blade 132 in the direction that the blade 132 is moving relative to the travel path of the vehicle 100. The blade travel path of the blade [522] 132 predicts the location of the left and right outer edges 135 and 137, respectively, of the blade 132 at upcoming time periods as the vehicle 100 travels on the ground surface. In some embodiments, the blade travel path of the blade 132 predicts the location of the blade edge 133 of the blade 132 at upcoming time periods as the vehicle 100 travels on the ground surface.

In step 532, the ECU 150 displays the projected path of blade travel 530 that includes the left blade travel path 155 for the left outer edge 135 and the right blade travel path 157 for the right outer edge 137 of the blade 132 on the user interface 117 or other graphical user interface, GUI. In some embodiments, the ECU 150 will also display on the user interface 117 the grade profile that the blade 132 will be passing or traveling over as the vehicle 100 moves along the ground surface. The projected path of blade travel 530 that includes the left blade travel path 155 for the left outer edge 135 and the right blade travel path 157 for the right outer edge 137 of the blade 132 from step 530 is displayed on the user interface 117 so that the operator can make decisions based on the location of the blade 132 relative to the grade profile. The display of projected path of blade travel 530 of the blade 132 can be overlaid on a camera feed of the grade profile, projected onto a glass surface near the operator's line of sight to the blade 132, or visualized in a top down representation of the area in which the vehicle 100 is working, such as a map. The operator can, but is not required to, utilize the display of projected path of blade travel of the blade 132 to plan for blade movement of the blade 132.

In step 534, the ECU 150 utilizes the projected path of the blade travel from step 530 in grade control automation and/or obstacle automation. The ECU 150 utilizes the projected path of blade travel 530 that includes the left blade travel path 155 for the left outer edge 135 and the right blade travel path 157 for the right outer edge 137 of the blade 132 from step 530 to determine whether the blade 132 needs adjustment based on automation features that are used in specific locations within the jobsite relative to the grade profile. The ECU 150 looks forward in time relative to the grade profile to prepare the blade 132 to meet the upcoming grade profile and certain upcoming criteria of the grade profile. An example of upcoming criteria includes a desired surface feature in the grade profile. For example, the desired surface feature could include a location for a light pole or manhole within the grade profile that the vehicle 100 is working on. The ECU 150 determines if the current blade trajectory of the blade 132 or the projected path of the blade travel from step 530 would move soil or dirt to cover the desired surface feature manhole. In one embodiment, the ECU 150 determines and makes the necessary adjustments to the position or orientation of the blade 132 to avoid covering the manhole with dirt as the vehicle 100 travels along the ground surface. In particular, the ECU 150 can direct one or more of the blade slope/position sensor 140, mainfall sensor 142, the right and left extensible and retractable actuators 126 and 128, respectively, and/or the extensible and retractable side swing actuator 130, to move the blade 132 in any direction necessary to avoid covering the manhole with dirt in this example. In another embodiment, the ECU 150 displays a message on the user interface 117 so that the operator can direct movement of the blade 132 to avoid covering the manhole with dirt in this example. It should be appreciated that this is only one example and that the blade 132 and the present disclosure contemplates many different upcoming criteria and desired surface features.

Another example of upcoming criteria includes an obstacle in the grade profile. As the vehicle 100 moves along the ground surface, the sensor 148 generates image data which is transmitted to the ECU 150. The ECU 150 is configured to process the received image data to determine the location and size of any surface irregularities 202 and 203 including length, height, depth, and distance to the irregularity. The ECU 150 determines the upcoming or anticipated ground contour with the image sensor 148 that can include surface irregularities 202 and 203. The memory 161 includes, in one or more embodiments, an object detector. Using one or more of the identified objects, distances, irregularities 202 and 203, the location of the surface irregularities 202 and 203 is determined by the ECU 150. The ECU 150 is further configured to determine, based on the received image content, whether the irregularities are within the projected path of blade travel 530 that includes the left blade travel path 155 for the left outer edge 135 and the right blade travel path 157 for the right outer edge 137 of the blade 132 from step 530 to determine whether the blade 132 needs adjustment based on whether the obstacle 202 and 203 is within the projected path of blade travel 530.

If the surface irregularities 202 and 203 are within the projected path of blade travel 530 that includes the left blade travel path 155 for the left outer edge 135 and the right blade travel path 157 for the right outer edge 137 of the blade 132 from step 530, the ECU 150 indicates a warning to the vehicle 100. If not, then warnings to the vehicle 100 are suspended based on the determined location of the surface irregularity 202 and 203 outside the projected path of blade travel 530. As such, the operator is only alerted of objects or surface irregularities that are within the projected path of blade travel 530 and could thereby cause damage to the blade 132. For any objects outside the projected path of blade travel 530, then no warning signals are displayed and the operator continues to operate the vehicle 100.

Additionally, in some embodiments, the warning of the upcoming collision could include audible alerts and/or stopping the vehicle 100 to avoid a collision with the blade 132 and the obstacle 202. In other embodiments, the obstacle automation feature on the ECU 150 will automatically move the blade 132 to avoid contact or collision between the blade 132 and the obstacle 202. If the object's measured location of the obstacle 203 is not within the projected path of the blade travel 530, then the ECU 150 will not instruct any visual indication on the user interface 117.

In some forms, the ECU 150 adjusts or decreases a speed of the vehicle 100 by automatically engaging the brakes based on the determined location of the surface irregularity 202 and 203 within the projected path of blade travel 530. In some embodiments, if the vehicle is moving at a slower speed then a shorter stopping distance will used, however if the vehicle 100 is moving at a higher or faster speed then a longer stopping distance will be used.

While this disclosure has been described with respect to at least one embodiment, the present disclosure can be further modified within the spirit and scope of this disclosure. This application is therefore intended to cover any variations, uses, or adaptations of the disclosure using its general principles. Further, this application is intended to cover such departures from the present disclosure as come within known or customary practice in the art to which this disclosure pertains.

What is claimed is:

1. A motor grader comprising:

a front frame supported on a pair of front wheels that are mounted on a front axle;

a rear frame supported on a pair of rear wheels that are mounted on a rear axle, the rear frame coupled with the front frame;

a blade movably attached to the front frame, the blade having a blade length that spans between a left outer edge and a right outer edge;

a vehicle grade control system including:

one or more sensors arranged to sense a position of one or more actuators operably coupled with the blade, wherein the one or more sensors are also arranged to sense an articulation angle of the rear frame relative to the front frame, wherein the one or more sensors are also arranged to sense a front wheel steering angle of the pair of front wheels;

a controller including a computing device having a processor and a memory, the controller operatively coupled to the one or more sensors to receive the sensed position of the one or more actuators, the sensed position of the articulation angle, and the sensed position of the front wheel steering angle, the memory storing a grade profile of the ground surface, wherein the controller:

determines movement of the front frame and the rear frame based on the articulation angle and the front wheel steering angle as the pairs of front and rear wheels travel over a ground surface;

determines a blade position and a blade movement of the blade with respect to the front and the rear frames based on the sensed position of the one or more actuators and the determined movement of the front frame and the rear frame;

determines a blade trajectory path for a plurality of points along the blade length, including the left outer edge and the right outer edge, each blade trajectory path representing a predicted path over the ground surface that the corresponding point will travel as the motor grader moves, based on the determined movement of the front frame and the rear frame and the determined blade position and the blade movement of the blade; and compares, for each of the plurality of points, the corresponding blade trajectory path to the grade profile to determine a deviation between the blade trajectory path and the grade profile.

2. The motor grader of claim 1, wherein the blade trajectory path of the blade includes a left outer edge blade travel path of the left outer edge of the blade and a right outer edge blade travel path of the right outer edge of the blade.

3. The motor grader of claim 2, wherein the controller displays the blade trajectory paths of plurality of points along the blade length of the blade on a graphical user interface.

4. The motor grader of claim 2, wherein the controller compares the blade trajectory paths of the plurality of points along the blade length of the blade to the grade profile to determine whether a position of the blade needs adjustment.

5. The motor grader of claim 4, wherein the controller receives image data from an image sensor operatively coupled to the controller; and wherein the controller determines whether an obstacle in the image data is within any of the blade trajectory paths of the plurality of points along the blade length.

6. The motor grader of claim 1, wherein the controller determines the blade position and the blade movement of the blade with respect to the front and the rear frames includes:

the controller determines one or more machine assembly characteristics of the motor grader;

the controller determines a cylinder velocity of each of the one or more actuators; and the controller determines a rigid-body acceleration of the motor grader.

7. The motor grader of claim 6, wherein the controller determines the blade position and the blade movement of the blade with respect to the motor grader includes:

the controller receiving from a user an operator command to direct the blade movement of the blade.

8. The motor grader of claim 6, wherein the controller determines the blade position and the blade movement of the blade with respect to the front and the rear frames includes:

the controller determines a machine footprint of the front frame and the rear frame.

9. The motor grader of claim 1, further comprising:

wherein the controller determines a blade travel path relative to the grade profile; and the controller automatically moves the blade in response to the grade profile to adjust the blade travel path.

10. The motor grader of claim 1, wherein the controller determines one or more physical characteristics of a machine assembly of the motor grader;

wherein the controller determines the movement of the front frame and the rear frame is based on the one or more physical characteristics of the machine assembly of the motor grader; and wherein the controller determines the blade position and the blade movement of the blade with respect to the front and the rear frames is based on the one or more physical characteristics of the machine assembly of the motor grader.

11. The motor grader of claim 10, wherein the one or more physical characteristics of the machine assembly of the motor grader includes a blade length, a blade height, and a blade thickness of the blade.

12. The motor grader of claim 10, wherein the one or more physical characteristics of the machine assembly of the motor grader includes a cylinder mounting location for each of the actuators on the motor grader or the actuators assembled with the blade.

13. The motor grader of claim 1, wherein the one or more actuators include any of a right and a left extensible and retractable actuator, a circle side shift actuator, a side swing actuator, and a blade lift valves assembly.

14. A method of determining a blade trajectory path of a blade movably attached to a motor grader having a front frame supported on a pair of front wheels that are mounted on a front axle and a rear frame supported on a pair of rear wheels that are mounted on a rear axle, the rear frame coupled with the front frame, the method comprising:

determining, via a controller including a computing device having a processor and a memory, a position of one or more actuators operably coupled with the blade;

determining, via the controller, an articulation angle of the rear frame relative to the front frame;

determining, via the controller, a front wheel steering angle of the pair of front wheels;

accessing, via the controller, a grade profile of a ground surface;

determining, via the controller, movement of the front frame and the rear frame based on the articulation angle and the front wheel steering angle as the pairs of front and rear wheels travel over a ground surface;

determining, via the controller, a blade position and a blade movement of the blade with respect to the front and the rear frames based on the sensed position of the one or more actuators and the determined movement of the front frame and the rear frame;

determining, via the controller, for a plurality of points along the blade length, including at least a left outer edge and a right outer edge of the blade, a blade trajectory path for each of the plurality of points based on the determined movement of the front frame and the rear frame and the determined blade position and the blade movement of the blade; and generating, via the controller, display data for a graphical user interface representing the blade trajectory paths relative to the grade profile to guide operation of the motor grader.

15. The method of claim 14, further comprising:

determining, via the controller, a blade travel path of the blade relative to the grade profile of the ground surface.

16. The method of claim 15, further comprising:

moving, via the controller, the blade automatically in response to the grade profile to adjust the blade travel path.

17. The method of claim 14, wherein the determining, via the controller, the blade position and the blade movement of the blade with respect to the front and the rear frames includes:

determining, via the controller, one or more machine assembly characteristics of the motor grader;

determining, via the controller, a cylinder velocity of each of the one or more actuators; and determining, via the controller, a rigid-body acceleration of the motor grader.

18. The method of claim 14, wherein the one or more actuators include any of a right and a left extensible and retractable actuator, a circle side shift actuator, a side swing actuator, and a blade lift valves assembly.

19. The method of claim 14, wherein the blade trajectory path comprises blade trajectory paths for the plurality of points along the blade length, including a left outer edge blade travel path of the left outer edge of the blade and a right outer edge blade travel path of the right outer edge of the blade.

20. The method of claim 14, further comprising:

receiving from a user an operator command to direct the blade movement of the blade; and moving via the controller the blade in response to the directed blade movement.

* * * * *